US006528162B1

(12) United States Patent
Teranishi et al.

(10) Patent No.: US 6,528,162 B1
(45) Date of Patent: Mar. 4, 2003

(54) ACRYLIC SYNTHETIC FIBER, USE THEREOF, AND PROCESS FOR PRODUCING ACRYLIC SYNTHETIC FIBER

(75) Inventors: Shuji Teranishi, Hofu (JP); Ituhiro Sakata, Hofu (JP)

(73) Assignees: Kanebo, Limited, Tokyo (JP); Kanebo Gohsen, Limited, Osaka (JP)

( * ) Notice: Subject to any disclaimer, the term of this patent is extended or adjusted under 35 U.S.C. 154(b) by 0 days.

(21) Appl. No.: 09/958,071

(22) PCT Filed: Mar. 8, 2000

(86) PCT No.: PCT/JP00/01418

§ 371 (c)(1),
(2), (4) Date: Jan. 17, 2002

(87) PCT Pub. No.: WO00/58535

PCT Pub. Date: Oct. 5, 2000

(30) Foreign Application Priority Data

Mar. 29, 1999 (JP) ..... 11-85596

(51) Int. Cl.[7] ..... D01F 6/00
(52) U.S. Cl. ..... 428/372; 428/395; 264/172.1
(58) Field of Search ..... 428/372, 323, 428/395; 442/327; 264/172.1

(56) References Cited

U.S. PATENT DOCUMENTS 4,775,585 A * 10/1988 Hagiwara et al. ..... 428/323
4,911,899 A * 3/1990 Hagiwara et al. ..... 423/118

FOREIGN PATENT DOCUMENTS

JP 9-87924 * 3/1997
JP 9-157978 * 6/1997
JP 9-176917 * 7/1997

* cited by examiner

*Primary Examiner*—N. Edwards
(74) *Attorney, Agent, or Firm*—Flynn, Thiel, Boutell & Tanis, P.C.

(57) ABSTRACT

The gist of the present invention is an acrylic synthetic fiber comprising 0.5 to 20.0% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component.

According to the present invention, a comfort fiber material was realized by providing with three functions required strongly by consumers, for example, deodorizing performance, antibacterial/bacteriostatic performance and water absorption/sweat absorption performance. Consequently, it is made possible to provide consumers with a high quality, safe/sanitary, healthy and comfort life style.

3 Claims, No Drawings

ACRYLIC SYNTHETIC FIBER, USE THEREOF, AND PROCESS FOR PRODUCING ACRYLIC SYNTHETIC FIBER

TECHNICAL FIELD

The present invention relates to a high-compound function acrylic synthetic fiber, which has three functions such as deodorizing performance, antibacterial/bacteriostatic performance and water absorption/sweat absorption performance and is also superior in washing durability, and a method of producing the same and a nonwoven fabric.

BACKGROUND ART

Acrylic synthetic fibers have widely been used in clothes, bedding, upholstery and the like. In these uses, deodorizing performance, antibacterial/bacteriostatic performance and water absorption/sweat absorption performance are indispensable to a comfort and healthy life style. Although products having a compound function obtained by fiber mixing, mixed spinning, union cloth or union knit of deodorizing fibers, antibacterial/bacteriostatic fibers and water absorption/sweat fibers and products having a compound function obtained by applying a post-processing system to a single function material have hitherto been marketed, these products require special facilities and production technologies and are uneconomical due to high cost.

Japanese Unexamined Patent Publication (Kokai) No 9-87924 and Japanese Unexamined Patent Publication (Kokai) No 9-157978 disclose an acrylic synthetic fiber having both antibacterial and deodorizing performances and a fiber product containing the same. Although these publications relate to an acrylic synthetic fiber containing a silicic acid metal salt or an aluminosilicic acid metal salt, fiber products described in these publications had poor water absorption/sweat absorption performances.

The present invention have made a trial of improving the technologies described above and found that an acrylic synthetic fiber comprising a fine powder containing a silicic acid metal salt or aluminosilicic acid metal salt having a specific apparent specific gravity as an active component has antibacterial/bacteriostatic performance and deodorizing performance superior, which are superior to the prior art, and is also superior in water absorption/sweat absorption performance, thereby leading to the completion of the present invention.

An object of the present invention is to provide a high-compound function acrylic synthetic fiber, which has three functions required strongly by consumers, for example, deodorizing performance, antibacterial/bacteriostatic performance and water absorption/sweat absorption performance, and is also superior in washing durability, a method of producing the same and a nonwoven fabric, for the purpose of aiming at a high quality life and providing a safe/sanitary, healthy and comfort life style.

DISCLOSURE OF THE INVENTION

The gist of the present invention is an acrylic synthetic fiber comprising 0.5 to 20.0% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component.

Also, it is a method of producing an acrylic synthetic fiber, which comprises uniformly dispersing 10 to 40% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component, in a solvent; adding the dispersion to a dope of a copolymer containing acrylonitrile; and spinning the mixed solution.

Furthermore, it is a nonwoven fabric comprising at least 10% by weight or more of the acrylic synthetic fiber of an acrylic synthetic fiber comprising 0.5 to 20.0% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component.

BEST MODE FOR CARRYING OUT THE INVENTION

The present invention will now be described in detail.

The acrylic synthetic fiber used in the present invention is made of an acrylonitrile copolymer containing at least 40% by weight of acrylonitrile, and any copolymerizable monomer can be used in combination with the acrylonitrile. Examples thereof include those which are obtained by copolymerizing an appropriate combination of a neutral monomer such as acrylic acid alkyl ester (e.g. methyl acrylate, ethyl acrylate, etc.), methacrylic acid alkyl ester (e.g. methyl methacrylate, ethyl methacrylate, etc.), styrene, vinyl acetate, vinyl chloride, vinylidene chloride, vinyl ethyl ether, or methacrylonitrile, an acid monomer such as acrylic acid, methacrylic acid, allylsulfonic acid, methallylsulfonic acid, styrenesulfonic acid, or 2-acrylamide-2-methylpropanesulfonic acid, and an ammonium salt or an alkali metal salt of these monomers in the proportion of 60% by weight or less. These acrylic copolymers may be prepared by any method such as suspension polymerization method, solution polymerization method, emulsion polymerization or the like.

The fine powder used in the present invention contains, as an active component, a silicic acid metal salt or aluminosilicic acid metal salt having a three-component composition of 5–70% by weight of $SiO_2$, 5–80% by weight of $MO_{n/2}$ and 1–35% by weight of $Al_2O_3$ in terms of oxide (M represents at least one metal selected from zinc, copper, silver, cobalt, nickel, iron, titanium, barium, tin, magnesium or zirconium, and n represents a valence of metal).

It is considered that such a metal salt has both properties of a solid acid and a solid base in a crystal thereof and also independently exists on the surface of one solid particle to form an amphoteric adsorption face without neutralizing with each other and, therefore, it exerts excellent deodorizing effect on a basic malodorous substance and an acidic malodorous substance by means of a chemical adsorption action. It is also considered that the metal salt is superior in contact efficiency with the malodorous substance because of large specific surface area and small apparent specific gravity, and also has a physical adsorption action, thereby making it possible to effectively deodorize. It is considered that the antibacterial/bacteriostatic performance originates in metal ions retained on at least a portion of fine powders, though the mechanism thereof is not sure.

The apparent specific gravity of the fine powder containing a silicic acid metal salt or aluminosilicic acid metal salt as an active component used in the present invention is 0.5 g/cm$^3$ or less, and preferably from 0.5 to 0.2 g/cm$^3$. The apparent specific gravity of the fine powder is important to the water absorption performance and deodorizing performance. When the apparent specific gravity exceeds 0.5 g/cm$^3$, the water absorption performance and the deodorizing performance are drastically lowered. In the present invention, the water absorption performance as well as extremely excellent deodorizing performance and bacteriostatic performance are obtained by incorporating a fine powder having (very) small apparent specific gravity into an acrylic synthetic fiber. The fine powder having (very) small apparent specific gravity attains the water absorption performance from voids formed in the vicinity of the fine powder in the fiber. Furthermore, the contact efficiency with the malodorous substance and the bacteria medium could be improved and a rapid improvement in deodorizing performance and antibacterial/bacteriostatic performance could also be achieved.

It is necessary that the average particle diameter of the fine powder containing a silicic acid metal salt or aluminosilicic acid metal salt as an active component used in the present invention is from 0.5 to 10 $\mu$m. When the average particle diameter of the fine powder is less than 0.5 $\mu$m, agglomeration is liable to occur and it becomes difficult to uniformly disperse the fine powder unless a special dispersing device or a dispersant is not used. On the other hand, when the average particle diameter of the fine powder exceeds 10 $\mu$m, an increase in filtration pressure and fiber breakage occur during spinning and, therefore, it is not preferred in view of the operability. In view of the dispersion stability of the dispersion of the fine powder and the spinning operation stability, the average particle diameter is more preferably from 1 to 6 $\mu$m. Although the particle size distribution of the fine powder is not specifically limited, the fine powder having a more narrow particle size distribution is preferred, as a matter of course, in view of the quality stability and production stability.

The specific surface area of the fine powder containing a silicic acid metal salt or aluminosilicic acid metal salt as an active component used in the present invention is preferably 100 m$^2$/g or more, and particularly preferably 150 m$^2$/g or more, in terms of a BET specific surface area. When the BET specific surface area is less than 100 m$^2$/g, the contact efficiency between the fine powder and the malodorous substance is lowered and, therefore, sufficient deodorizing capacity can not be exerted.

The amount of the fine powder containing a silicic acid metal salt or aluminosilicic acid metal salt as an active component used in the present invention is from 0.5 to 20.0% by weight, and preferably from 1.0 to 15.0% by weight, based on the acrylonitrile copolymer. When the content of the fine powder is less than 0.5% by weight, sufficient deodorizing performance, antibacterial/bacteriostatic performance and water absorption/sweat absorption performance can not be imparted. On the other hand, when the content exceeds 20.0% by weight, the fiber-formability, physical properties of the single fiber and spinnability are drastically lowered during the spinning and, therefore, it is not preferred.

As the solvent used in the present invention, any solvent may be used as far as it can dissolve the acrylonitrile copolymer. Examples thereof include organic solvents such as dimethylformamide, dimethylacetamide, dimethyl sulfoxide, acetone and the like and these organic solvent in view of the solubility, recovery of the solvent, and handling.

To maintain the dispersion stability of the fine powder and to avoid sedimentation of the fine powder in case the fine powder containing a silicic acid metal salt or aluminosilicic acid metal salt as an active component used in the present invention is dispersed with stirring, dispersants are preferably used in combination. The dispersant is not specifically limited, but an amphoteric surfactant and an anionic surfactant are more preferred as compared with a nonionic surfactant and a cationic surfactant when the solvent, in which the dispersant is dispersed, is a protic high-polar solvent.

In case of dispersing the fine powder containing a silicic acid metal salt or aluminosilicic acid metal salt as an active component used in the present invention in a solvent solution, wetting characteristics come into question. Since the fine powder having small apparent specific gravity, large BET specific surface area and large average particle diameter exhibits poor wetting characteristics to the solvent solution, the surface of the fine powder to be dispersed is preferably hydrophilized. The hydrophilization method is not specifically limited but includes, for example, surface treatment with a hydrophilic surfactant, treatment for hydrophilization of the surface of a fine powder or the like.

In case of dispersing the fine powder containing a silicic acid metal salt or aluminosilicic acid metal salt as an active component used in the present invention in the solvent, a physical grinding facility such as wet mill, sand grinder or the like is used in preferably used in view of the dispersion stability, prevention of sedimentation, spinning operation and quality stability. However, the fine powder of the present invention can be spun without using a special facility.

The method of incorporating the fine powder containing a silicic acid metal salt or aluminosilicic acid metal salt as an active component into the acrylonitrile copolymer may be, for example, a method of adding a dispersion, which is prepared by dispersing a fine powder containing a silicic acid metal salt or aluminosilicic acid metal salt as an active component in a solvent, to a spinning stock solution prepared by dissolving an acrylonitrile copolymer immediately before spinning, followed by mixing.

In the method of dispersing and dissolving the fine powder containing a silicic acid metal salt or aluminosilicic acid metal salt as an active component used in the present invention in a solvent and the method of adding the resulting solution to a spinning stock solution containing an acrylonitrile copolymer, followed by mixing, the mixing operation can be sufficiently carried out by a conventional mixer.

In the present invention, the concentration of the fine powder containing a silicic acid metal salt or aluminosilicic acid metal salt as an active component to be dispersed in the dispersion is from 5 to 40% by weight, and preferably from 10 to 35% by weight. When the concentration is less than 5% by weight, the concentration of the acrylonitrile copolymer in the spinning stock solution is reduced and, therefore, the fiber-formability and physical properties of the fiber are lowered. On the other hand, when the concentration exceeds 40% by weight, good dispersion can not be obtained, thereby making it impossible to produce the fiber industrially easily.

As far as the characteristics of the present invention are not impaired, conventionally used functional modifiers such as titanium doxide, flame retardants, light proofing agent and heat accumulating agents may be further added.

The resulting spinning stock solution is spun through a conventional spinneret. All publicly known wet, dry-wet and dry spinning methods can be applied as the spinning method and the spinning may be carried out under the same conditions as those in case of a conventional acrylic synthetic fiber.

Although the spinning conditions are not specifically limited as far as a stable operation can be carried out under the conditions, the spinning entire draw ratio is preferably as high as possible so as to form voids in the vicinity of the fine powder contained in the fiber. For example, high draw ratio is preferably selected in the drawing step after drying and densifying in case of the wet spinning method. Although the drawing temperature conditions after drying and densifying are not specifically limited, the draw ratio is 1.2 time or more, and preferably 1.3 times or more. High draw ratio is preferred for deodorizing performance, antibacterial/bacteriostatic performance and water absorption/sweat absorption performance as far as physical properties of the single fiber are not drastically lowered and a stable operation can be carried out.

As far as the characteristics of the present invention are not impaired, surface modifiers such as coating may be used in combination with the silicic acid metal salt or aluminosilicic acid metal salt so as to improve the solvent dispersion stability and the wetting characteristics with the solvent.

To the fiber of the present invention, any uses, products and production methods, which can be realized in a general acrylic synthetic fiber, can be applied. In this case, other fibers (for example, natural fiber such as cotton fiber and synthetic fiber such as modacrylic fiber) may be mixed in the product of the present invention. The mixing method includes, for example, mixed spinning method, mixed weaving method, cross knitting method or the like.

The nonwoven fabric of the present invention will now be described. The nonwoven fabric of the present invention is a nonwoven fabric containing at least 10% by weight or more of the acrylic synthetic fiber described above. This nonwoven fabric can provide a functional nonwoven fabric while maintaining functional characteristics such as deodorizing performance, antibacterial/bacteriostatic performance and water absorption/sweat absorption performance of the above-described acrylic synthetic fiber according to the present invention.

It is necessary that the nonwoven fabric comprising at least 10% by weight or more of the acrylic synthetic fiber of an acrylic synthetic fiber comprising 0.5 to 20.0% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component. When the amount of the acrylic synthetic fiber is less than 10% by weight, the deodorizing performance and antibacterial/bacteriostatic performance of the nonwoven fabric are drastically lowered, thereby making it impossible to impart desired high level function.

To make the most of viewpoint of cost performance as well as functional characteristics of a mixing material as a merit of composite textile fabric and composite nonwoven fabric, the content of the acrylic synthetic fiber is as small as possible as far as high functions such as deodorizing performance and antibacterial/bacteriostatic performance of the acrylic synthetic fiber according to the present invention can be maintained. Preferred is a nonwoven fabric containing 10 to 50% by weight, and more preferably 10 to 35% by weight of the acrylic synthetic fiber of the present invention.

The mixing material may be either a natural finer or a chemical fiber and is not specifically limited as far as the nonwoven fabric contains 10% by weight or more of the fiber of the present invention. The mixing method may be any publicly known method. Any method may be used as far as the nonwoven fabric contains 10% by weight or more of the fiber, for example, single-layer nonwoven fabric using a material alone or in combination with the other material, and multi-layer nonwoven fabric.

In the production of the nonwoven fabric, any conventionally known method can be employed. Various single-layer and multi-layer nonwoven fabrics can be produced by using, for example, apparatuses for production of dip bond nonwoven fabric, heat fusing nonwoven fabric, needle punch nonwoven fabric, stitch bond nonwoven fabric, span bond nonwoven fabric, wet nonwoven fabric and the like.

Specific uses and products of the present invention include pile goods (e.g. bore sheet, blanket, etc.), cover/side texture goods (e.g. sheet, pillow case, futon cover, etc.), cotton wool pad goods (e.g. futon, kotatsu futon, Japanese cushion, bed pad, pillow, cushion, etc.), robe, throw blanket, bedspread, bathrobe, bath towel, body towel, etc. in the field of bedding. In the field of interiors, there can be exemplified toiletry goods (e.g. toilet seat cover, toilet lid cover, toilet mat, etc.), drapery goods (e.g. curtain, lace, casement, blind cloth, etc.), carper goods (e.g. entrance/bath/kitchen mat, rug, carpet, hot carpet, etc.), cover cloth goods for OA chair,upholstery, etc., lining for kotatsu futon, and table cloth.

In the field of clothes, there can be exemplified inner goods (e.g. underwear, tights, spats, leg warmer, etc.), outer goods (e.g. sweater, fleece, fake fur, inter liner for protection against the cold, etc.), socks goods (e.g. socks, etc.), room wears (e.g. apron, coverall apron, urinal stall, hood cape, pajama, etc.) and business uniforms (e.g. white robe, surgical clothes, etc.). In the field of materials, there can be exemplified footwears (e.g. slipper, animal shoes, shoes for protection against the cold, etc.), dust controlling goods (e.g. business mat, cleaning mop, etc.) and building materials for residence (e.g. wallpaper, etc.).

In the field of nonwoven fabrics, there can be exemplified nonwoven fabrics for residence and building materials (e.g. sheet for prevention of dew condensation, curing sheet, low partition, high partition, ceiling material, wallpaper, etc.), agricultural nonwoven fabrics, business/household wiping nonwoven fabrics (e.g. industrial wiper for food supply center such as catering and door-to-door parcel delivery service, wet towel, business dishcloth, flooring wiper, toilet tissue, wet tissue, paper towel, etc,), household sundry nonwoven fabrics (e.g. bag, sheet, wrapping cloth, packing material, cover for clothes, draining bag, etc.), filter nonwoven fabrics (e.g. building air-conditioning filter, automobile filter, household air cleaner filter, business air cleaner filter, mask, cleaner filter, etc.), nonwoven fabrics for use as automobile interior skin materials and secondary materials (e.g. needle punch carpet, ceiling material, wading members, etc.), medical nonwoven fabrics, for example, surgical nonwoven fabrics (e.g. gown, drape, mask, cap, sheet, towel, underpant with hole, underpant for patient, surgical underwear, sterilized packing material, shoes cover, delivery pack, gauze, etc.) and base nonwoven fabric for percutaneous drug such as cataplasm, plaster, etc., nonwoven fabrics for sanitary materials such as paper diaper member, sanitary napkin member, etc., disposal clothes used in medical care, nursing care, laboratory, food processing and food manufacturing, nonwoven fabrics for clothes (e.g. liner for clothes, sweat absorbing pad, bust pad, etc.), nonwoven fabrics for shoes members (e.g. shoes liner, insole, etc.). The products and uses are not specifically limited. Any publicly known production method may be used as the method of producing products and half finished products.

EXAMPLES

The following examples further illustrate the present invention.

In the examples, parts and percentages are by weight unless otherwise stated.

[Deodorizing Performance]

Evaluation of the deodorizing performance of the fiber product was carried out with respect to typical malodorous substances in a daily life, for example, basic malodorous substances which emit ammonia odor (e.g. putrid odor of meats, cigarette odor, etc.), trimethylamine odor (e.g. putrid odor of fishes, etc.) and methylmercaptan odor (e.g. putrid odor of vegetables, etc.) and acidic malodorous substances which emit acetic acid odor (e.g. body odor emitted by decomposition of a sweat component, cigarette odor, etc.).

Method for measurement of trimethylamine (hereinafter abbreviated to TMA) elimination ratio: 3 g of a sample was placed in a Tedlar bag (made of vinylidene fluoride film, 5 liter) and, after sealing the Tedlar bag, 3 liter of a nitrogen gas was further charged. After the Tedlar bag was filled with TMA in the concentration of 100 ppm and allowed to stand for 2 hours, the TMA concentration was measured by a detecting tube. As a control, a vacant Tedlar bag was filled with TMA in the concentration of 100 ppm and allowed to stand for 2 hours, the TMA concentration was measured by a detecting tube and the elimination ratio of TMA was calculated from the reduction in concentration.

Method for measurement of ammonia elimination ratio: 3 g of a sample was placed in a Tedlar bag (made of vinylidene fluoride film, 5 liter) and, after sealing the Tedlar bag, 3 liter of a nitrogen gas was further charged. After the Tedlar bag was filled with ammonia in the concentration of 40 ppm and allowed to stand for 2 hours, the ammonia concentration was measured by a detecting tube. As a control, a vacant Tedlar bag was filled with ammonia in the concentration of 40 ppm and allowed to stand for 2 hours, the ammonia concentration was measured by a detecting tube and the elimination ratio of ammonia was calculated from the reduction in concentration.

Method for measurement of methylmercaptan (hereinafter abbreviated to MMP) elimination ratio: 3 g of a sample was placed in a Tedlar bag (made of vinylidene fluoride film, 5 liter) and, after sealing the Tedlar bag, 3 liter of a nitrogen gas was further charged. After the Tedlar bag was filled with MMP in the concentration of 100 ppm and allowed to stand for 2 hours, the MMP concentration was measured by a detecting tube. As a control, a vacant Tedlar bag was filled with MMP in the concentration of 100 ppm and allowed to stand for 2 hours, the MMP concentration was measured by a detecting tube and the elimination ratio of MMP was calculated from the reduction in concentration.

Method for measurement of acetic acid elimination ratio: 3 g of a sample was placed in a Tedlar bag (made of vinylidene fluoride film, 5 liter) and, after sealing the Tedlar bag, 3 liter of a nitrogen gas was further charged. After the Tedlar bag was filled with acetic acid in the concentration of 100 ppm and allowed to stand for 2 hours, the acetic acid concentration was measured by a detecting tube. As a control, a vacant Tedlar bag was filled with acetic acid in the concentration of 100 ppm and allowed to stand for 2 hours, the acetic acid concentration was measured by a detecting tube and the elimination ratio of acetic acid was calculated from the reduction in concentration.

[Antibacterial/bacteriostatic Performance]

Using a knit product obtained by spinning using a 2 inch spinning system and circular knitting of a 27-count single fiber and a nonwoven fabric itself as a sample, the antibacterial performance of the fiber was evaluated by a bacteriostatically active value in accordance with the "viable count method" as accreditation criteria of antibacterial/deodorant processed products enacted by SEK(Japanese Association for the Function Evaluation of Textiles).

[Washing Durability]

A washing durability test was carried out in accordance with JIS L 1018 "Method for Use of Household Electric Washing Machine". Samples were put in a household washing net, together with a knit product and a nonwoven fabric, and then washed. The sample which had been washed 0 times (W0) and the sample which had been washed 5 times (W5) were used for evaluation of the deodorizing performance and antibacterial/bacteriostatic performance.

[Water Absorption Ratio]

After 0.5 g of a sample was dipped in pure water for 30 minutes, water between fibers was removed by treating at 3500 rpm using a centrifugal separator for 2 minutes and the weight (Wa) was measured. Furthermore, this cotton was dried and the dry weight (Wb) was measured. The water absorption ratio was calculated by the following equation.

$$\text{Water absorption ratio } (\%)=(Wa-Wb)/Wb\times 100$$

[Liquid Retention Ratio]

A test was carried out in accordance with JIS K 7223 "Method for Water Absorption Test of Super Absorbent Polymer" and the liquid retention ratio was calculated by the equation described below.

A nonwoven fabric sample 7 cm squares was dipped in artificial urine (prepared by dissolving 9 g of sodium chloride, 20 g of urea and 1 g of creatine in 1 liter of deionized water) for 2 hours, thereby enabling the sample to retain artificial urea. After a lapse of 2 hours, the sample was allowed to stand while its corner was vertically suspended with a hook for 15 minutes, in order to remove excess artificial urea which could not penetrate into tea bag. After leaving for 15 minutes, the weight (Wc) was measured. This sample was dried and the dry weight (Wd) was measured. The liquid retention ratio was calculated by the following equation.

$$\text{Liquid absorption ratio } (\%)=(Wc-Wd)/Wd\times 100$$

[Apparent Specific Gravity]

The apparent specific gravity of the fine powder containing a silicic acid metal salt or aluminosilicic acid metal salt as an active component was measured in accordance with JIS K 6220 "Test Method for Rubber Compound Ingredient".

[BET Specific Surface Area]

The BET specific surface area of the fine powder containing a silicic acid metal salt or aluminosilicic acid metal salt as an active component was calculated from an adsorption amount of a gas measured by "MULTISORB-12" manufactured by YUASA IONICS INC. in accordance with the BET theory.

Examples 1 to 6 and Comparative Examples 1 to 6

An acrylonitrile copolymer was prepared in the following procedure. Solution polymerization of an acrylonitrile copolymer consisting of acrylonitrile (hereinafter abbreviated to AN)/methyl acrylate/sodium 2-acrylamide-2-methylpropanesulfonate (hereinafter abbreviated to SAM)= 90/9/1 (%) was carried out in dimethylformamide (hereinafter abbreviated to DMF) in the presence of azobisisobutyronitrile as an initiator and the residual monomer was removed. Then, the concentration of the acrylonitrile copolymer was adjusted to 20 to 30%.

A fine powder, which contains an aluminosilicic acid metal salt having a three-component composition of 30%

$SiO_2$, 10% $Al_2O_3$ and 60% ZnO as an active component and has an apparent specific gravity and an average particle diameter shown in Table 1-1, was used. The concentration of the fine powder in the DMF dispersion was adjusted to 30% or 25%. The dispersion stability in the DMF dispersion was generally evaluated with respect to agglomeration, sedimentation and wettability, and the results were judged by three-rank criteria of "○ (good)", "Δ (slightly poor)" and "× (poor)". The resulting DMF dispersion was added to the above acrylonitrile copolymer in the additive ratio shown in Table 1-1, followed by mixing to prepare a dope.

The dope was spun into an aqueous 58% DMF solution at 22° C., drawn while removing the solvent, washed with water, and then dried and densified after coating with an oil agent. The resulting fiber was subjected to steam-drawing, crimping and wet heat setting. The spinning operability was generally evaluated with respect to the filtration pressure, single fiber breakage, roller winding and yield in the production under the conditions described in the Examples, and the results were judged by three-rank criteria of "○ (good)", "Δ (slightly poor)" and "× (poor)". With respect to the fiber quality, the single fiber strength, elongation, light resistance and dyeability of the respective Examples were evaluated by comparing with those of a conventional acrylic synthetic fiber and the results were judged by two-rank criteria of "○ (good)" and "Δ (slightly poor)".

In Comparative Examples 1 to 2, the acrylonitrile copolymer and the same fine powder used in Examples 1 to 6 were used, except that the apparent specific gravity of the fine powder was not within the range defined above. In Comparative Examples 3 to 4, the average particle diameter of the fine powder used in Examples 1 to 6 was not within the range defined above. In Comparative Examples 5 to 6, the amount (% by weight) of the fine powder was not within the range defined above. Each step and each evaluation were carried out in the same manner as in Examples 1 to 6. The results are summarized in Table 1-1 to Table 1-3.

TABLE 1-1

| | Fine powder | | | Producing conditions | | Operation stability | | |
|---|---|---|---|---|---|---|---|---|
| | Apparent specific gravity g/cm$^3$ | Average particle diameter μm | BET specific surface area m$^2$g | Concentration of dispersion % by weight | Additive ratio of fine powder % by weight | Fine powder dispersion stability | Spinning operability | Quality of fiber |
| Examples | | | | | | | | |
| 1 | 0.21 | 0.5 | 428 | 30 | 10 | Δ | Δ | Δ |
| 2 | 0.29 | 3 | 322 | 30 | 10 | ○ | ○ | ○ |
| 3 | 0.36 | 3.5 | 200 | 30 | 10 | ○ | ○ | ○ |
| 4 | 0.48 | 3.5 | 105 | 30 | 10 | ○ | ○ | ○ |
| 5 | 0.38 | 5.5 | 200 | 30 | 10 | ○ | Δ | ○ |
| 6 | 0.41 | 9.5 | 205 | 30 | 10 | Δ | Δ | Δ |
| Comp. Examples | | | | | | | | |
| 1 | 0.7 | 3.5 | 50 | 30 | 10 | ○ | ○ | ○ |
| 2 | 0.59 | 7 | 120 | 30 | 10 | Δ | Δ | ○ |
| 3 | 0.4 | 11 | 170 | 25 | 5 | Δ | X | — |
| 4 | 0.25 | 0.2 | 300 | 25 | 5 | X | X | — |
| 5 | 0.36 | 3.5 | 200 | 30 | 25 | ○ | X | — |
| 6 | 0.36 | 3.5 | 200 | 30 | 0.3 | ○ | ○ | ○ |

TABLE 1-2

| | Deodorizing performances | | | | | | | |
|---|---|---|---|---|---|---|---|---|
| | Trimethylamine Elimination ratio (%) | | Ammonia Elimination ratio (%) | | Methylmercaptane Elimination ratio (%) | | Acetic acid Elimination ratio (%) | |
| | W0 | W5 | W0 | W5 | W0 | W5 | W0 | W5 |
| Examples | | | | | | | | |
| 1 | 90 | 95 | 85 | 89 | 92 | 96 | 85 | 88 |
| 2 | 98 | 100 | 95 | 98 | 98 | 99 | 93 | 95 |
| 3 | 100 | 100 | 100 | 100 | 100 | 100 | 99 | 100 |
| 4 | 85 | 92 | 83 | 89 | 91 | 93 | 81 | 86 |
| 5 | 98 | 100 | 100 | 100 | 100 | 100 | 98 | 100 |
| 6 | 100 | 100 | 100 | 100 | 100 | 100 | 99 | 100 |
| Comp. Examples | | | | | | | | |
| 1 | 15 | 13 | 10 | 12 | 8 | 8 | 5 | 6 |
| 2 | 28 | 29 | 19 | 21 | 17 | 15 | 14 | 16 |

TABLE 1-2-continued

| | Deodorizing performances | | | | | | | |
|---|---|---|---|---|---|---|---|---|
| | Trimethylamine Elimination ratio (%) | | Ammonia Elimination ratio (%) | | Methylmercaptane Elimination ratio (%) | | Acetic acid Elimination ratio (%) | |
| | W0 | W5 | W0 | W5 | W0 | W5 | W0 | W5 |
| 3 | | | | impossible to spin | | | | |
| 4 | | | | impossible to spin | | | | |
| 5 | | | | impossible to spin | | | | |
| 6 | 5 | 4 | 2 | 3 | 5 | 4 | 7 | 8 |

[Supplementary explanation]
(1) W0: raw cotton. washing 0 times,
(2) W5: washing 5 times,
(3) —: impossible to measure and evaluate

TABLE 1-3

| | Antibacterial/bacteriostatic performance | | | | |
|---|---|---|---|---|---|
| | *Staphylococcus aureus* | | *Klebsiella pneumoniae* | | Water absorption ratio |
| | W0 | W5 | W0 | W5 | % |
| Examples | | | | | |
| 1 | >6 | >6 | >6 | >6 | 10 |
| 2 | >6 | >6 | >6 | >6 | 12 |
| 3 | >6 | >6 | >6 | >6 | 12 |
| 4 | >6 | >6 | >6 | >6 | 9 |
| 5 | >6 | >6 | >6 | >6 | 13 |
| 6 | >6 | >6 | >6 | >6 | 16 |
| Comp. Examples | | | | | |
| 1 | 3.8 | 2.5 | 4.3 | 3.3 | 2.5 |
| 2 | 4.5 | 3.8 | 4.7 | 4.1 | 3 |
| 3 | | | impossible to spin | | |
| 4 | | | impossible to spin | | |
| 5 | | | impossible to spin | | |
| 6 | 0.48 | 0.29 | 0.4 | 0.21 | 0.5 |

[Supplementary explanation]
(1) W0: raw cotton, washing 0 times,
(2) W5: washing 5 times As is apparent from Table 1-1 to Table 1-3, in Comparative Examples 1 to 2 wherein the apparent specific gravity of the fine powder is larger than the range defined above, the spinning operability and fiber quality were good and the antibacterial performance was good, while both the deodorizing performance and water absorption performance were drastically poor and insufficient.

Comparative Example 3 wherein the average particle diameter of the fine powder is larger than the range defined above, spinning could not be carried out because an increase in filtration pressure and fiber breakage occurred during the spinning. In Comparative Example 4, since the average particle diameter of the fine powder was too small, secondary agglomeration occurred during the dispersion of DMF, thereby making it difficult to separate and making it impossible to spin.

In Comparative Example 5 wherein the amount (% by weight) of the fine powder is large than the range defined above, a stable operation could not be carried out because an increase in filtration pressure and fiber breakage occurred frequently during the spinning. In Comparative Example 6, since the amount of the fine powder was too small, the functionality was poor, though the spinning operability and fiber quality were good.

Examples 7 to 11 and Comparative Examples 7 to 11

An acrylonitrile copolymer was prepared in the following procedure. Solution polymerization of an acrylonitrile copolymer consisting of AN/vinylidene chloride/SAM=57/40/3 (%) was carried out in DMF in the presence of azobisvaleronitrile as an initiator and the residual monomer was removed. Then, the concentration of the acrylonitrile copolymer was adjusted to 20 to 30%.

A fine powder, which has an apparent specific gravity of 0.38 g/cm$^3$, an average particle diameter of 3.5 $\mu$m and a BET specific surface area of 200 m$^2$/g and also has the same composition of the aluminosilicic acid metal salt, as the active component of the fine powder, as in Example 1 to 6, was used. The concentration of the dispersion was adjusted as shown in Table 2-1. The resulting dispersion was added to the above acrylonitrile copolymer in the additive ratio shown in Table 2-1, followed by mixing to prepare a spinning stock solution.

The spinning stock solution was spun into an aqueous 57% DMF solution at 18° C., drawn while removing the solvent, washed with water, and then dried and densified after coating with an oil agent. The resulting fiber was subjected to drawing, shrinking and crimping steps, and then crimp setting was carried out by a wet heat treatment. The spinning operability was generally evaluated with respect to the filtration pressure, single fiber breakage, roller winding and yield of the fiber in the production under the conditions described in the Examples, and the results were judged by three-rank criteria of "○ (good)", "Δ (slightly poor)" and "×(poor)". With respect to the fiber quality, the single fiber strength, elongation, light resistance and dyeability of the respective Examples were evaluated by comparing with those of a conventional acrylic synthetic fiber and the results were judged by two-rank criteria of "○ (good)" and "Δ (slightly poor)".

In Comparative Examples 7 to 8, the acrylonitrile copolymer and the same fine powder used in Examples 7 to 11 were used, except that the additive ratio was not within the range defined above. Each step and each evaluation were carried out in the same manner as in Examples 7 to 11.

Example 12

In the same manner as in Examples 7 to 11, except for using a fine powder, which contains an aluminosilicic acid metal salt having a three-component composition of 55% $SiO_2$, 17% $Al_2O_3$ and 28% CuO as an active component, and also has an apparent specific gravity of 0.40 g/cm$^3$, an average particle diameter of 3.0 $\mu$m and a BET specific surface area of 185 m$^2$/g.

Example 13

In the same manner as in Examples 7 to 11, except for using a fine powder, which contains an aluminosilicic acid metal salt having a three-component composition of 67% $SiO_2$, 13% $Al_2O_3$ and 20% $Ag_2O$ as an active component, and also has an apparent specific gravity of 0.38 g/cm$^3$, an average particle diameter of 3.3 $\mu$m and a BET specific surface area of 193 m$^2$/g.

Comparative Example 9

In the same manner as in Examples 7 to 11, except for using a fine silica-alumina powder having a composition of 81% $SiO_2$ and 19% $Al_2O_3$, the active component of which is neither a silicic acid metal salt nor an aluminosilicic acid metal salt, and also has an apparent specific gravity of 0.33 g/cm$^3$, an average particle diameter of 3.3 $\mu$m and a BET specific surface area of 220 m$^2$/g. The results are summarized in Table 2-1 to Table 2-3.

TABLE 2-1

| | Fine powder | | | Producing conditions | | Operation stability | | |
|---|---|---|---|---|---|---|---|---|
| | Apparent specific gravity g/cm$^3$ | Average particle diameter $\mu$m | BET specific surface area m$^2$g | Concentration of dispersion % by weight | Additive ratio of fine powder % by weight | Fine powder dispersion stability | Spinning operability | Quality of fiber |
| Examples | | | | | | | | |
| 7 | 0.38 | 3.5 | 200 | 15 | 1 | ○ | ○ | ○ |
| 8 | 0.38 | 3.5 | 200 | 25 | 5 | ○ | ○ | ○ |
| 9 | 0.38 | 3.5 | 200 | 30 | 10 | ○ | ○ | ○ |
| 10 | 0.38 | 3.5 | 200 | 32.5 | 15 | Δ | ○ | Δ |
| 11 | 0.38 | 3.5 | 200 | 35 | 20 | Δ | Δ | Δ |
| 12 | 0.4 | 3.0 | 185 | 25 | 5 | ○ | ○ | Δ |
| 13 | 0.38 | 3.0 | 193 | 25 | 5 | ○ | ○ | Δ |
| Comp. Examples | | | | | | | | |
| 7 | 0.38 | 3.5 | 200 | 40 | 25 | Δ | X | — |
| 8 | 0.38 | 3.5 | 200 | 10 | 0.3 | ○ | ○ | ○ |
| 9 | 0.33 | 3.3 | 220 | 30 | 10 | ○ | Δ | Δ |
| 10 | 0.38 | 3.5 | 200 | 45 | 10 | X | X | — |
| 11 | 0.38 | 3.5 | 200 | 9 | 5 | ○ | X | — |

[Supplementary explanation]
(1) W0: raw cotton, washing 0 times,
(2) W5: washing 5 times,
(3) —: impossible to measure and evaluate

TABLE 2-2

| | Deodorizing performances | | | | | | | |
|---|---|---|---|---|---|---|---|---|
| | Trimethylamine Elimination ratio (%) | | Ammonia Elimination ratio (%) | | Methylmercaptane Elimination ratio (%) | | Acetic acid Elimination ratio (%) | |
| | W0 | W5 | W0 | W5 | W0 | W5 | W0 | W5 |
| Examples | | | | | | | | |
| 7 | 62 | 58 | 60 | 54 | 64 | 61 | 55 | 53 |
| 8 | 70 | 82 | 75 | 83 | 70 | 74 | 68 | 76 |
| 9 | 100 | 100 | 100 | 100 | 100 | 100 | 99 | 100 |
| 10 | 100 | 100 | 100 | 100 | 100 | 100 | 98 | 100 |
| 11 | 100 | 100 | 100 | 100 | 100 | 100 | 99 | 100 |
| 12 | 100 | 100 | 98 | 100 | 100 | 100 | 99 | 100 |
| 13 | 95 | 98 | 100 | 100 | 100 | 100 | 95 | 99 |
| Comp. Examples | | | | | | | | |
| 7 | | | | impossible to spin | | | | |
| 8 | 2 | 3 | 5 | 4 | 3 | 2 | 5 | 7 |
| 9 | 5 | 4 | 3 | 6 | 5 | 4 | 5 | 4 |
| 10 | | | | impossible to spin | | | | |
| 11 | | | | impossible to spin | | | | |

[Supplementary explanation]
(1) W0: raw cotton. washing 0 times,
(2) W5: washing 5 times,

TABLE 2-3

| | Antibacterial/bacteriostatic performance | | | | |
|---|---|---|---|---|---|
| | *Staphylococcus aureus* | | *Klebsiella pneumoniae* | | Water absorption ratio (voids) |
| | W0 | W5 | W0 | W5 | % |
| Examples | | | | | |
| 7 | 2.5 | 2.25 | 3 | 2.7 | 8 |
| 8 | 4.1 | 3.9 | 4 | 3.9 | 10 |
| 9 | 5 | 4.9 | 5.3 | 4 | 12 |
| 10 | >6 | >6 | >6 | >6 | 16 |
| 11 | >6 | >6 | >6 | >6 | 20 |
| 12 | >6 | >6 | >6 | >6 | 12 |
| 13 | >6 | >6 | >6 | >6 | 11 |
| Comp. Examples | | | | | |
| 7 | | | impossible to spin | | |
| 8 | 1.2 | 0.55 | 1.4 | 0.7 | 1 |
| 9 | 0.45 | 0.29 | 0.43 | 0.41 | 2 |
| 10 | | | impossible to spin | | |
| 11 | | | impossible to spin | | |

[Supplementary explanation]
① W0: raw cotton, washing 0 times,
② W5: washing 5 times As is apparent from Table 2-1 to Table 2-3, in Comparative Example 7 wherein the additive ratio (content, % by weight) of the fine powder is larger than the range defined above, spinning could not be carried out because of an increase in filtration pressure and spinneret pressure. In Comparative Example 8 wherein the additive ratio of the fine powder is smaller than the range defined above, sufficient deodorizing performance, antibacterial/bacteriostatic performance and water absorption/sweat absorption performance could not be obtained, through the spinning operability and fiber quality were good. When using neither a silicic acid metal salt nor an aluminosilicic acid metal salt, like Comparative Example 9, the functionality is poor.

In Comparative Example 10 wherein the concentration (% by weight) of the dispersion of the fine powder is larger than the range defined above, agglomeration and sedimentation occurred and the stability of the dispersion becomes drastically poor, thereby making it difficult to spin. In Comparative Example 11 wherein the concentration of the dispersion of the fine powder is smaller than the range defined above, spinning could not be carried out because of formation of a large number of microvoids and single fiber breakage caused by a reduction in polymer concentration of the acrylonitrile copolymer. In contrast with these Comparative Examples, satisfactory results were obtained in the deodorizing performance, antibacterial performance, water absorption performance, washing durability and fiber quality in the Examples.

Examples 14 to 15 and Comparative Example 12

The same fiber (3.3 dtex) as that used in Example 3 was used as a fiber A and a regenerated polyester short fiber 310 (fineness: 2.2 dtex) manufactured by Oshima Sangyo Co., Ltd. was used as a fiber B.

Three kinds of mixed products having different mixing ratios of the fiber A to the fiber B of the present invention were separately scraped off and mixed, and then subjected to mixing/blowing, air transfer, carding, needle punching and thermal embossing to obtain three kinds of needle punch nonwoven fabrics having a weight of 200 g/m$^2$. The mixing ratio (by weight) of the fiber A to the polyester short fiber B of the present invention in the needle punch nonwoven fabric, for example, A:B=30:70 was shown in Example 14, A:B=10:90 was shown in Example 15, and A:B=5:95 was shown in Comparative Example 12.

Examples 16 to 17 and Comparative Example 13

Similar to Examples 14 to 15, the same fiber (3.3 dtex) as that used in Example 3 was used as a fiber A and a heat fusing polyester short fiber 4080 (fineness: 2.2 dtex) manufactured by UNITIKA LTD. was used as a fiber C.

Three kinds of mixed products having different mixing ratios of the fiber A to the fiber C of the present invention were separately scraped off and mixed, and then subjected to mixing/blowing, air transfer, carding, and thermal bonding using a hot air system where the flexibility is regarded as important in combination with a calendering system to obtain three kinds of thermal bond nonwoven fabrics having a weight of 20 g/m$^2$. The mixing ratio (by weight) of the fiber A to the heat fusing short fiber C of the present invention in the thermal bond nonwoven fabric, for example, A:C=30:70 was shown in Example 16, A:C=10:90 was shown in Example 17, and A:C=5:95 was shown in Comparative Example 13.

Examples 18 to 19 and Comparative Example 14

Similar to Examples 14 to 15, the same fiber (3.3 dtex) as that used in Example 3 was used as a fiber A and a pre-breached cotton breached by Nihon Sanmo Dyeing Co., Ltd. was used as a cotton D.

Three kinds of mixed products having different mixing ratios of the fiber A to the fiber D of the present invention were separately scraped off and mixed, and then subjected to mixing/blowing, air transfer, carding, and water-jetting (Perfojet Inc.) to obtain three kinds of spun lace nonwoven fabrics having a weight of 50 g/m$^2$. The mixing ratio (by weight) of the fiber A to the cotton D of the present invention in the nonwoven fabric, for example, A:D=30:70 was shown in Example 18, A:D=10:90 was shown in Example 19, and A:D=5:95 was shown in Comparative Example 14.

Examples 20 to 21 and Comparative Example 15

Similar to Examples 14 to 15, the same fiber (3.3 dtex) as that used in Example 3 was used as a fiber A, a PP/PE heat fusing fiber ES (2.2 dtex) manufactured by CHISSO CORPORATION was used as olefinic heat fusing fiber E, and a pre-breached cotton breached by Nihon Sanmo Dyeing Co., Ltd. was used as a cotton D.

Three kinds of mixed products having different mixing ratios of the fiber A to the fiber E of the present invention were separately scraped off and mixed, and then subjected to mixing/blowing, air transfer, carding, and thermal bonding using a hot air system where the flexibility is regarded as important in combination with a calendering system to obtain three kinds of thermal bond nonwoven fabrics having a weight of 20 g/m$^2$. In the thermal bond nonwoven fabric, a nonwoven fabric X has the mixing ratio (by weight) of the fiber A to the olefinic heat fusing short fiber E of the present invention, for example, A:E=50:50, a nonwoven fabric Y has the mixing ratio A:E=25:75, and a nonwoven fabric Z has the mixing ratio A:E=10:90.

These three kinds of nonwoven fabrics X, Y and Z are separately laminated on a web-like cotton D having a weight of 20 g/m$^2$ and then jet-bonded to obtain two-layer structure spun lace nonwoven fabrics. The mixing ratio (by weight) between the fiber A, the cotton D and the olefinic heat fusing short fiber E of the present invention in the thermal bond nonwoven fabric, A:D:E=25:50:25 was shown in Example 20, A:D:E=12.5:50:37.5 was shown in Example 21, and A:D:E=5:50:45 was shown in Comparative Example 15.

As is apparent from Table 3-1 and Table 3-2, at least 10% by weight or more of the fiber of the present invention must be mixed with the nonwoven fabric regardless of the kind of the mixing fiber when a functional nonwoven fabric is made

TABLE 3-1

| | Mixing ratio of fiber (% by weight) | | | | | | | |
|---|---|---|---|---|---|---|---|---|
| | A Fiber of the present invention | B Polyester short fiber | C Heat fusing polyester | D Cotton | E Olefin heat fusing | Method of producing nonwoven fabric | Structure of nonwoven fabric | Evaluation of functionality |
| Examples | | | | | | | | |
| 14 | 30 | 70 | — | — | — | needle punch | single layer | ○ |
| 15 | 10 | 90 | — | — | — | needle punch | single layer | Δ |
| 16 | 30 | — | 70 | — | — | thermal bond | single layer | ○ |
| 17 | 10 | — | 90 | — | — | thermal bond | single layer | Δ |
| 18 | 30 | — | — | 70 | — | jet bond (spun lace) | single layer | ○ |
| 19 | 10 | — | — | 90 | — | jet bond (spun lace) | single layer | Δ |
| 20 | 25 | — | — | 50 | 25 | thermal bond + jet bond | two-layer | ○ |
| 21 | 12.5 | — | — | 50 | 37.5 | thermal bond + jet bond | two-layer | Δ |
| Comp. Examples | | | | | | | | |
| 12 | 5 | 95 | — | — | — | needle punch | single layer | X |
| 13 | 5 | — | 95 | — | — | thermal bond | single layer | X |
| 14 | 5 | — | — | 95 | — | jet bond (spun lace) | single layer | X |
| 15 | 5 | — | — | 50 | 45 | thermal bond + jet bond | two-layer | X |

[Supplementary explanation]
(1) W0: raw cotton. washing 0 times,
(2) W5: washing 5 times,
(3) —: impossible to measure and evaluate

TABLE 3-2

| | Deodorizing performance | | | | | | | | Antibacterial/bacteriostatic performance | | | | Water absorption performance |
|---|---|---|---|---|---|---|---|---|---|---|---|---|---|
| | Trimethylamine Elimination ratio (%) | | Ammonia Elimination ratio (%) | | Ethylmercaptane Elimination ratio (%) | | Acetic acid Elimination ratio (%) | | *Staphylococcus aureus* | | *Klebsiella pneumoniae* | | Retention ratio of artificial urine (%) |
| | W0 | W5 | W0 | W5 | W0 | W5 | W0 | W5 | W0 | W5 | W0 | W5 | |
| Examples | | | | | | | | | | | | | |
| 14 | 100 | 100 | 100 | 100 | 100 | 100 | 99 | 100 | >6 | >6 | >6 | >6 | 852 |
| 15 | 70 | 72 | 70 | 69 | 73 | 70 | 75 | 78 | 4.1 | 3.9 | 4.0 | 3.9 | 728 |
| 16 | 98 | 100 | 99 | 100 | 100 | 100 | 97 | 100 | >6 | >6 | >6 | >6 | 744 |
| 17 | 60 | 68 | 59 | 65 | 60 | 62 | 60 | 65 | 4.5 | 4.2 | 4.3 | 4.2 | 680 |
| 18 | 100 | 100 | 100 | 100 | 100 | 100 | 99 | 100 | >6 | >6 | >6 | >6 | 682 |
| 19 | 65 | 66 | 60 | 62 | 63 | 64 | 62 | 65 | 3.8 | 4.5 | 4.2 | 4.2 | 615 |
| 20 | 100 | 100 | 100 | 100 | 100 | 100 | 99 | 100 | >6 | >6 | >6 | >6 | 992 |
| 21 | 75 | 78 | 70 | 68 | 75 | 79 | 70 | 69 | 4.8 | 4.3 | 4.0 | 4.2 | 870 |
| Comp. Examples | | | | | | | | | | | | | |
| 12 | 15 | 18 | 9 | 12 | 19 | 25 | 21 | 19 | 1.0 | 0.7 | 0.9 | 1.0 | 493 |
| 13 | 12 | 13 | 11 | 12 | 18 | 19 | 15 | 18 | 1.2 | 0.5 | 0.8 | 1.1 | 395 |
| 14 | 15 | 15 | 10 | 12 | 20 | 21 | 22 | 22 | 0.9 | 0.8 | 1.2 | 1.0 | 356 |
| 15 | 16 | 19 | 13 | 15 | 19 | 27 | 20 | 19 | 1.1 | 0.9 | 0.7 | 0.8 | 454 |

[Supplementary explanation]
(1) W0: raw cotton. washing 0 times,
(2) W5: washing 5 times, of the fiber of the present invention. In Comparative Examples 10 to 13 wherein 10% by weight or less of the fiber of the present invention is mixed with the nonwoven fabric, the deodorizing performance, antibacterial/bacteriostatic performance and water absorption/sweat absorption performance are drastically lowered. To the contrary, in Examples 14 to 21 wherein at least 10% by weight or more of the fiber of the present invention is mixed with the nonwoven fabric regardless of the method of producing the nonwoven fabric, the deodorizing performance, antibacterial/bacteriostatic performance and water absorption/sweat absorption (liquid absorption/urea absorption) performance can be imparted even if the mixing ratio is low such a 10 to 30%, thus obtaining a functional nonwoven fabric having extremely excellent cost performance by making the most of features of other fibers to be mixed.

INDUSTRIAL APPLICABILITY

According to the present invention, a comfort fiber material having excellent cost performance was realized by providing with three functions required strongly by consumers, for example, deodorizing performance, antibacterial/bacteriostatic performance and water absorption/sweat absorption performance. Consequently, it is made possible to provide consumers with a high quality, safe/sanitary, healthy and comfort life style.

What is claimed is:

1. An acrylic synthetic fiber comprising 0.5 to 20.0% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component.

2. A method of producing an acrylic synthetic fiber, which comprises uniformly dispersing 10 to 40% by weight of a fine powder, which contains a silicic acid metal salt or aluminosilicic acid metal salt having an apparent specific gravity of 0.5 g/cm$^3$ or less and an average particle diameter of 0.5 to 10 $\mu$m as an active component, in a solvent; adding the dispersion to a solution of a copolymer containing acrylonitrile; and spinning the mixed solution.

3. A nonwoven fabric comprising at least 10% by weight or more of the acrylic synthetic fiber of claim 1.

* * * * *